United States Patent [19]

Strunk et al.

[11] 4,393,992

[45] Jul. 19, 1983

[54] SPRINKLER HEAD ASSEMBLY

[76] Inventors: Norman E. Strunk, 401 McMaster Crescent, Saskatoon, Saskatchewan; Anton P. Pohoreski, Box 100, Asquith, Saskatchewan, both of Canada

[21] Appl. No.: 258,311

[22] Filed: Apr. 28, 1981

[51] Int. Cl.[3] ..... B05B 15/06

[52] U.S. Cl. ..... 239/200; 239/570; 239/600

[58] Field of Search ..... 239/200, 201, 570, 571, 239/572, 580, 583, 586, 600; 138/45, 46, 43; 251/285; 285/319, 191, DIG. 22

[56] References Cited

U.S. PATENT DOCUMENTS

| | | | |
|---|---|---|---|
| 2,963,264 | 12/1960 | Hruby | 138/45 X |
| 3,413,021 | 11/1968 | Potts | 285/319 |
| 3,451,431 | 6/1969 | Royer | 138/46 |
| 3,719,327 | 3/1973 | McMahan | 239/542 X |
| 3,797,755 | 3/1974 | Saisho | 239/600 X |
| 3,967,784 | 7/1976 | Ammon | 239/583 |

*Primary Examiner*—John J. Love
*Assistant Examiner*—Paul A. Sobel
*Attorney, Agent, or Firm*—Birch, Stewart, Kolasch & Birch

[57] ABSTRACT

Improvements are provided in a sprinkler head assembly including a hollow sprinkler head assembly tube, a sprinkler tip secured in the upper portion of that tube and a valve secured in the lower portion thereof. The sprinkler tip body is secured in the upper portion by cooperation between a securing structure which depends from the sprinkler tip, (e.g., a central tube having an internally threaded bore, the tube having a slit through the walls at its lower end forming bifurcated portions provided with a pair of wings, each having an upwardly facing abutting shoulder thereon), and retainers on the inner wall of the hollow sprinkler head assembly within the upper portion thereof, (e.g., a downwardly facing abutting shoulder spaced downwardly from the upper end of the tube) with an actuator for urging the securing structure into engagement with the retainers (e.g., a screw engaged within the bore which when screwed downwardly, spreads the wings, thus engaging the wing shoulders under the tube shoulders and securing the tip body portion in position). A valve assembly including a valve and seat secured within the lower portion of the hollow sprinkler head assembly tube includes a guide structure to guide the valve for reciprocal motion relative to the seat. A controller is manually operable to control the vertical position of the valve relative to the seat.

7 Claims, 3 Drawing Figures

SPRINKLER HEAD ASSEMBLY

BACKGROUND OF THE INVENTION (1) Field of the Invention

This invention relates to improvements in sprinkler head assemblies. More particularly, it relates to such sprinkler head assemblies which are incorporated in automatic sprinkling systems and which are positioned to give adequate coverage to the area being irrigated.

(2) Description of the Prior Art

Conventional sprinkler head assemblies are positioned so that adequate coverage is obtained with a relatively steady water supply pressure and even so, overlap must be provided for, because it is extremely difficult to calculate where each sprinkler head assembly should be situated. Furthermore, if the water pressure increases or decreases, overlap or starvation occurs. It is thus desirable to position the sprinkler heads as far apart as possible, yet still maintain adequate coverage, but this is difficult to obtain with conventional sprinkler head assemblies.

Also with conventional sprinkler head assemblies, the sprinkler head tips are preferably detachably secured within the upper end of the sprinkler tubes. This is normally achieved by screw threading, which is relatively expensive to incorporate in mass production methods and is time consuming in installation.

SUMMARY OF THE INVENTION

Aims of the Invention

The present invention aims to provide a sprinkler tip assembly which is easily inserted without screw threading and which is simply secured within the sprinkler head assembly.

The present invention also aims to provide means whereby the amount of water passing through indivieual sprinkler head tubes may be adjusted and controlled as desired.

STATEMENT OF THE INVENTION

The invention is embodied, in a first embodiment, by a sprinkler head assembly including a hollow sprinkler head assembly tube, a sprinkler tip secured within the upper portion of the hollow sprinkler head assembly tube, and a valve secured within the lower portion of the hollow sprinkler head assembly tube. The sprinkler head assembly includes (I) means for retaining the sprinkler tip within the hollow sprinkler head assembly tube, comprising (i) first securing means associated with the hollow sprinkler head assembly tube; (ii) second securing means depending from the sprinkler tip for insertion into the upper portion of the hollow sprinkler head assembly tube, the second securing means comprising a pair of diametrically opposite wings, the lower portions of which are normally biased towards one another, a central, longitudinally extending tube bifurcated at its lower end interconnecting the wings, an upwardly facing shoulder at the lower portion of each wing, and means associated with the bifurcated central tube for urging the abutment shoulders apart into secure engagement with the retaining means, the means including a rod disposed within the bifurcated tube, the rod being of slightly greater diameter than the threaded bore, whereby downward longitudinal movement of the rod urges the abutment shoulders apart into secure engagement with the retaining means; (iii) retaining means within the upper portion of the hollow sprinkler head assembly tube on the inner wall thereof; and (iv) means for urging the securing means into secure engagement with the retaining means, the means comprising the bifurcated tube and the rod. The sprinkler head assembly also includes (II) a valve assembly comprising a valve seat secured within the hollow sprinkler head assembly tube, a valve engageable with the seat, the valve including a head and a stem extending therefrom, the stem being provided with a head, means in the valve assembly to support and guide the valve for reciprocal motion relative to the seat, the valve stem being normally in a lower position with the valve in its fully opened position; and means to control vertical position of the valve relative to the seat, the control means comprising the abovementioned rod for urging the securing means into secure engagement with the retaining means whereby, when the rod urges the abutment shoulders apart into secure engagement with the retaining means, the rod also engages the stem head, thereby to limit upward movement of the valve stem.

This invention is embodied, in a second embodiment by sprinkler head assembly including a hollow sprinkler head assembly tube, a sprinkler tip secured within the upper portions of the hollow sprinkler head assembly tube, and a valve secured within the lower portion of the hollow sprinkler head assembly tube, comprising: (I) means for retaining the sprinkler tip within the hollow sprinkler head assembly tube, comprising: (i) first securing means associated with the hollow sprinkler head assembly tube, the first securing means comprising an upwardly facing abutment shoulder at the lower portion thereof, the abutment shoulder being engageable into secure engagement with a retaining means; (ii) second securing means depending from the sprinkler tip for insertion into the upper portion of the hollow sprinkler head assembly tube, the second securing means including a pair of diametrically opposite wings, the lower portions of which are normally biased towards one another, a central, longitudinally extending tube bifurcated at its lower end interconnecting the wings, the bifurcated central tube having an internally threaded bore; an upwardly facing shoulder at the lower portion of each the wings; and means comprising a screw of slightly greater diameter than that of the threaded bore associated with the bifurcated central tube for urging the abutment shoulders apart into secure engagement with the retaining means, (iii) retaining means within the upper portion of the hollow sprinkler head assembly tube on the inner wall thereof, the retaining means comprising a downwardly facing abutment shoulder formed on the inner wall of the hollow sprinkler head assembly tube provided by the inside diameter of the upper portion of the hollow sprinkler head assembly tube being less than the inside diameter of the lower portion of the sprinkler head assembly tube, thereby providing the downwardly facing abutment shoulder formed on the inner wall of the sprinkler head assembly tube; and means for urging the securing means into secure engagement with the retaining means, that means comprising the combination of the screw of slightly greater diameter than the threaded bore and the bifurcated tube, the screw being disppsed in the threaded bore of the bifurcated tube, whereby downward movement of the screw spreads the lower ends of the wings apart into secure engagement with the downwardly facing abutment shoulder; and (II) a valve assembly comprising a valve seat secured within the hollow sprinkler head assembly tube, a valve engageable with the seat, the valve including a head and a stem extending therefrom, the stem being provided with a head, means in the valve assembly to support and guide the valve for reciprocal motion relative to the seat, the valve stem being normally in a lower position with the valve in its fully opened position and means to control the vertical position of the valve relative to the seat; the control means comprising the rod for urging the securing means into secure engagement with the retaining means whereby, when the rod urges the abutment shoulders apart into secure engagement with the retaining means, the rod also engages the stem head, thereby to limit upward movement of the valve stem.

This invention is further embodied, in a third embodiment, by a sprinkler head assembly including a hollow sprinkler head assembly tube, a sprinkler tip secured within the upper portions of the hollow sprinkler head assembly tube, a valve secured within the lower portion of the hollow sprinkler head assembly tube, comprising (a) securing means depending from the sprinkler tip for insertion into the upper portion of the hollow sprinkler head assembly tube, the securing means including a pair of diametrically opposite wings, the lower portions of which are normally biased towards one another, a central, longitudinally extending tube bifurcated at its lower end interconnecting the wings, the bifurcated central tube having an internally threaded bore, an upwardly facing shoulder at the lower portion of each of the wings, and means comprising a screw of slightly greater diameter than that of the internally threaded bore of the bifurcated central tube threaded into the bifurcated central tube for urging the abutment shoulders apart into secure engagement with the retaining means; (b) retaining means within the upper portion of the hollow sprinkler head assembly tube on the inner wall thereof, the retaining means comprising a downwardly facing abutment shoulder formed on the inner wall of the sprinkler head assembly tube provided by the inside diameter of the upper portion of the hollow sprinkler head assembly tube being less than inside diameter of the lower portion of the hollow sprinkler head assembly tube, thereby providing the downwardly facing abutment shoulder formed on the inner wall of the sprinkler head assembly tube; (c) means for urging the securing means into secure engagement with the retaining means, the urging means comprising the combination of the screw of slightly greater diameter that the threaded bore, the screw being threaded into the threaded bore, whereby downward movement of the screw spreads the lower ends of the wings apart into secure engagement with the downwardly facing abutment shoulder; and (II) a valve assembly comprising a valve seat secured within the hollow sprinkler head assembly tube, a valve engageable with the seat, the valve including a head and a stem extending therefrom, the stem being provided with a head, means in the valve assembly to support and guide the valve for reciprocal motion relative to the seat, the valve stem being normally in a lower position with the valve in its fully opened position and means to control the vertical position of the valve relative to the seat, the control means comprising the screw for urging the securing means into secure engagement with said retaining means whereby, when the screw is urged to project beyond the threaded bore, it also engages the stem head, thereby to limit upward movement of the valve stem.

OTHER FEATURES OF THE INVENTION

By a feature of this first embodiment of this invention, the retaining means comprises a downwardly facing abutment shoulder formed on the inner wall of the hollow sprinkler head assembly tube.

By another feature of this first embodiment, the inside diameter of the upper portion of the sprinkler head assembly tube is less than the inside diameter of the lower portion of the sprinkler head assembly tube, thereby providing the downwardly facing abutment shoulder formed on the inner wall of the sprinkler head assembly tube.

By another feature of this first embodiment of this invention, the first securing means includes an upwardly facing abutment shoulder at the lower portion thereof, the abutment shoulder being urgeable into secure engagement with the retaining means.

By another feature of this first embodiment, the tube has an internally threaded bore, and the rod comprises a screw of slightly greater diameter than the threaded bore, whereby downward longitudinal movement of the screw urges the abutment shoulders apart into secure engagement with the retaining means.

By a specific feature of this first embodiment of this invention, an improvement is provided in a sprinkler head assembly including a hollow sprinkler head assembly tube, a sprinkler tip secured within the upper portions of the hollow sprinkler head assembly tube, and a valve secured within the lower portion of the hollow sprinkler head assembly tube, means for retaining the sprinkler tip within the hollow sprinkler head assembly tube, the improvement comprising: securing means depending from the sprinkler tip for insertion into the upper portion of the hollow sprinkler head assembly tube, the securing means including a pair of diametrically opposite wings, the lower portions of which are normally biased towards one another, a central, longitudinally extending tube bifurcated at its lower end interconnecting the wings, an upwardly facing shoulder at the lower portion of each of the wings, and means associated with the central bifurcated tube for urging the abutment shoulders apart into secure engagement with the retaining means, the central bifurcated tube having an internally threaded bore; retaining means within the upper portion of the hollow sprinkler head assembly tube on the inner wall thereof, the retaining means comprising a downwardly facing abutment shoulder formed on the inner wall of the sprinkler head assembly tube provided by the diameter of the upper portion of the sprinkler head assembly is less than the diameter of the lower portion of the sprinkler head assembly tube, thereby providing the downwardly facing abutment shoulder formed on the inner wall of the sprinkler head assembly tube; and means for urging the securing means into secure engagement with the retaining means, the means comprising the combination of a screw of slightly greater diameter than the threaded bore, the screw being disposed in the threaded bore, whereby downward movement of the screw spreads the lower ends of the wings apart into secure engagement with the downwardly facing abutment shoulder.

By a feature of this second embodiment of this invention, the valve stem is normally in a lower position with the valve in its fully opened position, and the stem is provided with a head engageable with the control means to limit the upward movement of the valve stem.

By another feature of this second embodiment, the control means comprises a screw, the end of which is adapted to rest in contact with the valve stem head.

In accordance with this invention, therefore, when first installed, each sprinkler head may be adjusted readily and easily to give adequate coverage with a predetermined set water pressure. If, at some other time, the water pressure increases or decreases, it is relatively easy to change the volume of water passing through individual sprinkler heads and thereby to adjust the coverage of each head as desired.

BRIEF DESCRIPTION OF THE DRAWINGS

In the accompanying drawings.

DESCRIPTION OF PREFERRED EMBODIMENT

Figure 1:
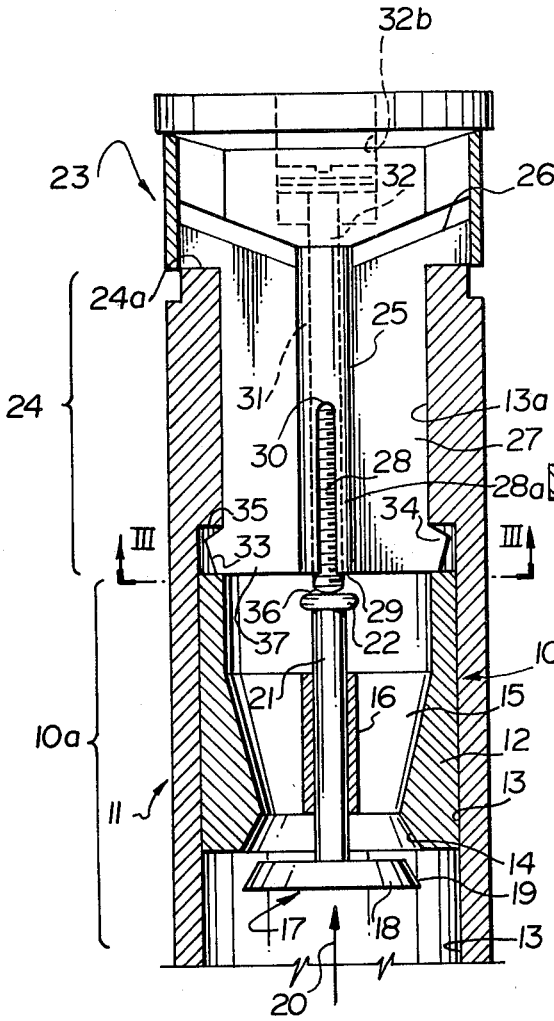
FIG. 1 is a partially sectioned view of the upper end of a sprinkler head assembly of one embodiment of this invention including a sprinkler tip and a valve assembly.
Figure 2:
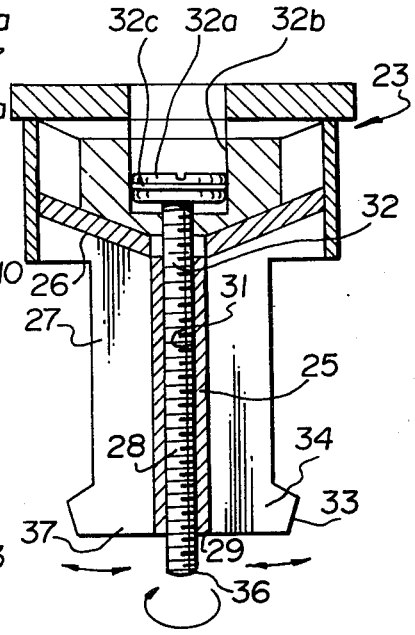
FIG. 2 is an enlarged, partially sectioned fragmentary view of the sprinkler tip of one embodiment of this invention showing one type of securing means.
Figure 3:
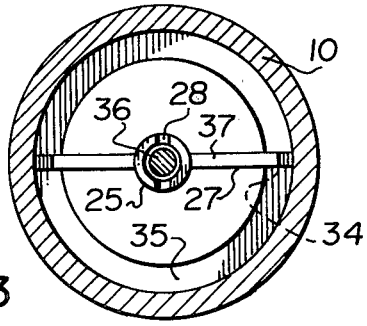
FIG. 3 is an enlarged cross-sectional view substantially along the line III—III of FIG. 1.

As seen in FIG. 1, reference character illustrates a conventional hollow sprinkler head assembly tube which is adapted to be secured to underground water lines (not illustrated) and which then is adapted to extend upwardly therefrom to terminate adjacent the ground surface level.

Incorporated within the lower portion 10*a* of the hollow sprinkler head assembly tube 10 is a valve assembly collectively designated 11. Valve assembly 11 consists of an annular cylindrical body portion 12 secured to the inner wall 13 of the tube by any conventional means, e.g., adhesive, screw threading or the like. The valve body portion 12 includes a frusto-conical valve seat 14 formed on the lower end thereof, the frusto-conical valve seat in this embodiment facing downwardly as clearly shown. A plurality of wings 15 extend inwardly from the body portion 12 above the valve seat 14 and support a valve guide tube 16. A valve, collectively designated 17, is mounted vertically within the guide tube 16 and is reciprocal therein, in a conventional manner.

The valve 17 includes an inverted frusto-conical valve head 18 which is provided with a valve seating face 19 of a configuration similar to that of the valve seat 14. The valve head 18, when engaged within the valve seat 14, serves to shut off water under pressure which may pass upwardly through the hollow sprinkler head assembly tube 10 in the direction of arrow 20.

An axially situated valve stem 21 extends upwardly from the center of the valve head 18 and is vertically reciprocally movable within the valve guide tube 16. An enlarged head portion 22 is formed or secured on the upper end of the valve stem 21 to prevent the valve from becoming displaced from the valve guide tube 16 when the valve stem 21 is in its lowermost position.

A sprinkler tip, collectively designated 23, is engaged within the upper portion 24 of the hollow sprinkler head assembly tube 10, above the valve assembly 11. The operation of the sprinkler tip is conventional. However, in this particular embodiment, the sprinkler tip is provided with securing means depending therefrom. This securing means includes a cylindrical central tube 25 interconnecting the pair of diametrically opposed wings 26 of the tip assembly. The wings 26 include a pair of planar wing-like extensions 27 extending radially outwardly from opposite sides of the cylindrical tube 25 with the space between the tube 25 and the inner wall 13*a* of the hollow sprinkler head assembly tube 10 acting as a water passage during operation of the sprinkler assembly.

The cylindrical tube 25 is bifurcated at the lower end thereof 28*a* by means of slots 28 extending from the base 29 to a point part-way along the length of the body portion indicated by reference character 30. The tube 25 is provided with an internally threaded bore 31. The sprinkler tip is preferably formed from a plastics material, e.g., polyvinylchloride.

A screw threadably engages the internally threaded bore 31. The bore 31 may be dimensioned so that engagement of the screw 32 therein froms the thread as the screw is screwed downwardly through the bore 31.

The head 32*a* of this screw is situated within a well 32*b* in the sprinkler tip 23 and an O-ring 32*c* or other equivalent seal engages between the peripheral wall of the head 32*a* of the screw 32 and the wall of the well 32*b* to prevent water leakage past the screw in the bore 31 and past the head 32*a* in the well 32*b*.

The wing-like extensions 27 are provided with enlarged outwardly extending lower end ribs 33 defining upwardly facing abutment shoulders 34 as clearly illustrated. When the screw 32 is not engaged within the bore 31, the width between the outer tips of the shoulders 34 is such that the sprinkler tip 23 may be pushed downwardly within the upper end 24 of the hollow sprinkler head assembly tube 10.

An annular, downwardly facing annular abutment shoulder 35 is provided on the inner wall 13 of the hollow sprinkler head assembly tube 10 spaced from the upper end thereof. As shown, this is provided by having the diameter of the upper end 24 of hollow sprinkler head assembly tube 10 less than the diameter of the lower end 10*a* of the hollow sprinkler head assembly tube 10. When the sprinkler tip 23 is inserted within the upper end 24, the shoulders 34 of the wing-like extensions 27 are situated just below the annular abutment shoulder 35 of the hollow sprinkler head assembly tube 10.

OPERATION OF PREFERRED EMBODIMENT

It will be appreciated that water under pressure, within the hollow sprinkler head assembly tube 10 will, in the absence of any restraining or control means, normally maintain the valve head 18 upon the valve seat 14, thus shutting off the flow of water.

When the screw 32 is screwed downwardly into the bore 31 and through the bifurcated portion 28*a* forming the lower end of the sprinkler tip 23, the screw expands the portion of the wing-like extensions 27 upon each side of the slot 28, thus forcing the wing-like extensions 27 outwardly and thereby engaging the abutment shoulders 34 under the abutment shoulders 35, thus holding the sprinkler tip assembly firmly in position within the hollow sprinkler head assembly tube 10.

It will be noted that the upper surfaces of the shoulders 34 slope outwardly and downwardly. This configuration and inclination facilitates withdrawal of the sprinkler tip assembly 23 is necessary after the screw 32 has been unscrewed from the bore 31. An upward pull on the sprinkler tip assembly 23 will cause the engagement of these sloping shoulders 34 with the shoulder 35 to close the bifurcated portion 28*a* and thus to permit withdrawal.

Further downward movement of the screw causes the inner end 36 to protrude below the lower end 29 of the tube 25. By adjusting the position of the screw 32, it will be noted that the uppermost position of the valve 17 may be controlled due to the fact that the lower end 36 of the screw 32 engages and contacts upon the head 22 of the valve stem 21. This enables the operator to control the degree of minimum opening between the valve head 18 and the valve seat 14, thereby controlling the volume of water passing upwardly through the hollow sprinkler head assembly tube 10 to the sprinkler tip assembly 23.

If the water pressure is greater than expected, or if the pattern formed by the individual sprinkler tip assembly 23 is too large, the screw 32 is unscrewed upwardly, thus allowing the valve head 18 to close slightly and thus to reduce the water flow and hence to reduce the pattern size.

If, on the other hand, water pressure is reduced, or if the pattern of the individual tip assembly is not sufficient, the screw 32 may be screwed downwardly, thus increasing the opening between the valve head 18 and the seat 14. This permits more water to pass therethrough and hence increases the pattern size.

This gives individual control over each sprinkler head and permits the sprinkler head to be adjusted not only for the pattern size due to positioning of the sprinkler heads, but also to the individual water pressure existing at each sprinkler head assembly.

BRIEF DESCRIPTION OF FURTHER EMBODIMENTS

It should be noted that the upper ends of the wing-like extensions 27 on each side of the cylindrical body 25 extend outwardly and engage the upper end 24*a* of the hollow sprinkler head assembly tube 10, thus limiting the downward movement of the tip assembly within the hollow sprinkler head assembly tube 10. It should also be appreciated that, although two wing-like extensions 27 are provided, nevertheless, if desired, more such extensions may be provided, depending on design parameters.

It will also be noted that if the sprinkler tipassembly 23 is removed for repair or cleaning or replacement purposes, the valve 17 will then be allowed to close, thus automatically closing off the water from that individual tube.

Finally, although the lower end of the tube is bifurcated to facilitate the spreading apart of the shoulders 34, nevertheless it should be appreciated that the construction and material used for the tube may be such that the screw will expand the lower end of the tube 25 radially, thus engaging the shoulder 34 under the shoulder 35 without bifurcation.

SUMMARY

From the foregoing description, one skilled in the art can easily ascertain the essential characteristics of this invention, and without departing from the spirit and scope thereof, can made various changes and modifications of the invention to adapt it to various usages and conditions. Consequently, such changes and modifications are properly, equitably, and "intended" to be, within the full range of equivalence of the following claims.

We claim:

1. A sprinkler head assembly including a hollow sprinkler head assembly tube, a sprinkler tip secured within the upper portion of said hollow sprinkler head assembly tube, and a valve secured within the lower portion of said hollow sprinkler head assembly tube, comprising (I) means for retaining said sprinkler tip within said hollow sprinkler head assembly tube, comprising:

(i) first securing means associated with said hollow sprinkler head assembly tube;

(ii) second securing means depending from said sprinkler tip for insertion into the upper portion of said hollow sprinkler head assembly tube, said second securing means comprising a pair of diametrically opposite wings, the lower portions of which are normally biased towards one another, a central longitudinally extending tube bifurcated at its lower end interconnecting said wings, an upwardly facing shoulder at the lower portion of each said wings, and means associated with said bifurcated central tube for urging said abutment shoulders apart into secure engagement with said retaining means, said means including a rod disposed within said bifurcated tube, said rod being of slightly greater diameter than said threaded bore; whereby downward longitudinal movement of said rod urges said abutment shoulders apart into secure engagement with said retaining means;

(iii) retaining means within the upper portion of said hollow sprinkler head assembly tube on the inner wall thereof; and (iv) means for urging said securing means into secure engagement with said retaining means, said means comprising said fiburcated tube and said rod; and (II) a valve assembly comprising a valve seat secured within said hollow sprinkler head assembly tube, a valve engageable with said seat, said valve including a head and a stem extending therefrom, said stem being provided with a head, means in said valve assembly to support and guide said valve for reciprocal motion relative to said seat, said valve stem being normally in a lower position with the valve in its fully opened position, and means to control the vertical position of said valve relative to said seat, said control means comprising said rod for said securing means into secure engagement with said retaining means whereby, when said rod urges said abutment shoulders apart into secure engagement with said retaining means, said rod also engages said stem head, thereby to limit upward movement of said valve stem.

2. The sprinkler head assembly of claim 1 wherein said retaining means (iii) comprises (v) a downwardly facing abutment shoulder formed on the inner wall of said hollow sprinkler head assembly tube.

3. The sprinkler head assembly of claim 2 wherein the inside diameter of the upper portion of said hollow sprinkler head assembly tube is less than the inside diameter of the lower portion of said hollow sprinkler head assembly tube, thereby providing said downwardly facing abutment shoulders (v) formed on the inner wall of said hollow sprinkler head assembly tube.

4. The sprinkler head assembly of claim 1 wherein said first securing means (i) includes an upwardly facing abutment shoulder at the lower portion thereof, said abutment shoulder being urgeable into secure engagement with said retaining means (iii).

5. The sprinkler head assembly of claim 1 wherein said bifurcated central tube has an internally threaded bore; and wherein said rod comprises a screw of slightly greater diameter than that of said threaed bore; whereby downward longitudinal movement of said screw urges said abutment shoulders apart into secure engagement with said retaining means.

6. A sprinkler head assembly including a hollow sprinkler head assembly tube, a sprinkler tip secured within the upper portions of said hollow sprinkler head assembly tube, and a valve secured within the lower portion of said hollow sprinkler head assembly tube, comprising:

(I) means for retaining said sprinkler tip within said hollow sprinkler head assembly tube, comprising: assembly tube, comprising:

(i) first securing means associated with said hollow sprinkler head assembly tube, said first securing means comprising an upwardly facing abutment shoulder at the lower portion thereof, said abutment shoulder being urgeable into secure engagement with a retaining means;

(ii) second securing means depending from said sprinkler tip for insertion into the upper portion of said hollow sprinkler head assembly tube, said second securing means including a pair of diametrically opposite wings, the lower portions of which are normally biased towards one another, a central, longitudinally extending tube bifurcated at its lower end interconnecting said wings, said bifurcated central tube having an internally threaded bore, an upwardly facing shoulder at the lower portion of each said wings, and means comprising a screw of slightly greater diameter than that of said threaded bore threaded into said bifurcated central tube for urging said abutment shoulders apart into secure engagement with said retaining means;

(iii) retaining means within the upper portion of said hollow sprinkler head assembly tube on the inner wall thereof, said retaining means comprising a downwardly facing abutment shoulder formed on the inner wall of said hollow sprinkler head assembly tube provided by the inside diameter of the upper portion of said hollow sprinkler head assembly tube being less than the inside diameter of the lower portion of said sprinkler head assembly tube, thereby providing said downwardly facing abutment shoulder formed on the inner wall of said sprinkler head assembly tube; and means for urging said securing means into secure engagement with said retaining means, said means comprising the combination of said screw of slightly greater diameter than said threaded bore and said bifurcated tube, said screw being threaded into said threaded bore, whereby downward movement of said screw spreads the lower ends of said wings apart into secure engagement with said downwardly facing abutment shoulder; and (II) a valve assembly comprising a valve seat secured within said hollow sprinkler head assembly tube, a valve engageable with said seat, said valve including a head and a stem extending therefrom, said stem being provided with a head, means in said valve assembly to support and guide said valve for reciprocal motion relative to said seat, said valve stem being normally in a lower position with the valve in its fully opened position and means to control the vertical position of said valve relative to said seat, said control means comprising said screw for urging said securing means into secure engagement with said retaining means whereby, when said screw urges said abutment shoulders apart into secure engagement with said retaining means, said screw also engages said stem head, thereby to limit upward movement of said valve stem.

7. A sprinkler head assembly including a hollow sprinkler head assembly tube, a sprinkler tip secured within the upper portion of said hollow sprinkler head assembly tube, comprising:

(I) means for retaining said sprinkler tip within said hollow sprinkler head assembly tube comprising:

(a) securing means depending from said sprinkler tip for insertion into the upper portion of said hollow sprinkler head assembly tube, said securing means including a pair of diametrically opposite wings, the lower portions of which are normally biased towards one another, a central, longitudinally extending tube bifurcated at its lower end interconnecting said wings said bifurcated central tube having an internally threaded bore, an upwardly facing shoulder at the lower portion of each said wings, and means comprising a screw of slightly greater diameter than that of said externally threaded bore threaded into said bifurcated central tube for urging said abutment shoulders apart into secure engagement with said retaining means;

(b) retaining means within the upper portion of said hollow sprinkler head assembly tube on the inner wall thereof, said retaining means comprising a downwardly facing abutment shoulder formed on the inner wall of said sprinkler head assembly tube provided by the inside diameter of the upper portion of said hollow sprinkler head assebmly tube being less than inside diameter of the lower portion of said hollow sprinkler head assembly tube, thereby providing said downwardly facing abutment shoulder formed on the inner wall of said sprinkler head assembly tube;

(c) means for urging said securing means into secure engagement with said retaining means, said urging means comprising the combination of said screw of slightly greater diameter than said threaded bore, and said bifurcated tube said screw being threaded into said threaded bore, whereby downward movement of said screw spreads the lower ends of said wings apart into secure engagement with said downwardly facing abutment shoulder; and (II) a valve assembly comprising a valve seat secured within said hollow sprinkler head assembly tube, a valve engageable with said seat, said valve including a head and a stem extending therefrom, said stem being provided with a head, means in said valve assembly to support and guide said valve for reciprocal motion relative to said seat, said valve stem being normally in a lower position with the valve in its fully opened position and means to control the vertical position of said valve realtive to said seat, said control means comprising said screw for urging said securing means into secure engagement with said retaining means whereby, when said screw is urged to project beyond said threaded bore, it also engages said stem head, thereby to limit upward movement of said valve stem.

* * * * *